US006792654B2

(12) United States Patent
Schmitz

(10) Patent No.: US 6,792,654 B2
(45) Date of Patent: Sep. 21, 2004

(54) BELT BUCKLE

(76) Inventor: Hans-Jörg Schmitz, Schulstrasse 4, D-42579, Heiligenhaus (DE)

( * ) Notice: Subject to any disclaimer, the term of this patent is extended or adjusted under 35 U.S.C. 154(b) by 0 days.

(21) Appl. No.: 10/240,619

(22) PCT Filed: Apr. 26, 2001

(86) PCT No.: PCT/DE01/01585

§ 371 (c)(1),
(2), (4) Date: Sep. 30, 2002

(87) PCT Pub. No.: WO01/82737

PCT Pub. Date: Nov. 8, 2001

(65) Prior Publication Data

US 2003/0106192 A1 Jun. 12, 2003

(30) Foreign Application Priority Data

May 2, 2000 (DE) ..... 200 07 724 U

(51) Int. Cl.[7] ..... A44B 11/25; A44B 11/26
(52) U.S. Cl. ..... 24/614; 24/634
(58) Field of Search ..... 24/614, 615, 633, 24/634, 625, 629, 643, 647, 648, 650

(56) References Cited

U.S. PATENT DOCUMENTS

| | | | | | |
|---|---|---|---|---|---|
| 3,262,169 | A | * | 7/1966 | Jantzen | |
| 3,404,439 | A | * | 10/1968 | Jones | |
| 3,523,342 | A | * | 8/1970 | Spires | |
| 3,648,333 | A | * | 3/1972 | Stoffel | 24/635 |
| 3,649,999 | A | * | 3/1972 | Stoffel | 24/635 |
| 4,053,966 | A | * | 10/1977 | Dieleman | 24/163 R |
| 4,321,734 | A | * | 3/1982 | Gandelman | |
| 4,991,272 | A | * | 2/1991 | Bianchi | 24/616 |
| 5,033,171 | A | * | 7/1991 | Kasai | 24/614 |
| 5,355,562 | A | * | 10/1994 | Matoba et al. | 24/625 |
| 6,378,466 | B1 | * | 4/2002 | Oyster et al. | 119/863 |

* cited by examiner

*Primary Examiner*—Robert J. Sandy
(74) *Attorney, Agent, or Firm*—R W Becker & Associates; R W Becker

(57) ABSTRACT

The invention relates to a belt buckle, comprising two buckle members fastened on belt ends, the first (1) of said members having a receiving compartment (6) in which the second buckle member (2) is axially inserted. Said second buckle member comprises snap-fit members that are adjusted against a spring force and that interact with undercuts in the first buckle member to secure the fitted buckle members (1,2). The inventive belt buckle is further characterized in that the buckle members consist of cast metal and that the snap-fit members are impinged upon by at least one mechanical return spring.

9 Claims, 2 Drawing Sheets

BELT BUCKLE

BACKGROUND OF THE INVENTION

The invention relates to a belt buckle that is comprised of two buckle members that can be secured to belt ends, with the first buckle member having a receiving means for the axial insertion of the second buckle member, which contains latching or snap-fit elements that are adjustable against spring force and that, to secure the inter-engaging buckle members, cooperate with undercuts in the first buckle member.

Such belt buckles are conventionally made of plastic, whereby the snap-fit elements of the second buckle member essentially have the shape of tongues, whereby the spring force, depending upon the material, is respectively a function of the plastic that is used.

The drawback of such plastic belt buckles is that they can break under abrupt shocks.

It is an object of the present invention to provide a belt buckle that is improved in this respect.

SUMMARY OF THE INVENTION

To realize this object, the buckle members are made of cast metal, whereby the snap-fit elements are pivotable about a rigid axis, and are supported by a mechanical spring, preferably a compression spring.

The buckle members are preferably made of cast brass or cast zinc, and have a surface that is processed or finished by shot hardening and subsequent galvanization.

BRIEF DESCRIPTION OF THE DRAWINGS

The invention will be described in greater detail subsequently with the aid of the drawing.

DESCRIPTION OF THE PREFERRED EMBODIMENTS

Figure 1:
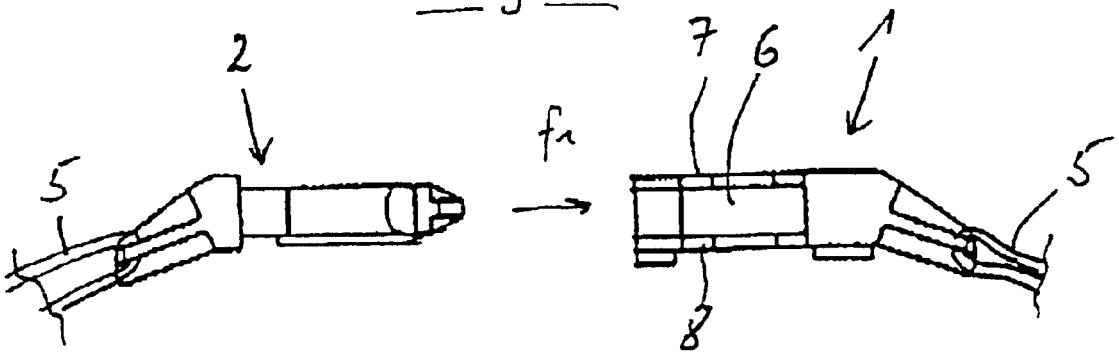
FIG. 1 shows a side view of the two buckle members, which can be inserted into one another in the direction of the arrow f1.
Figure 3:
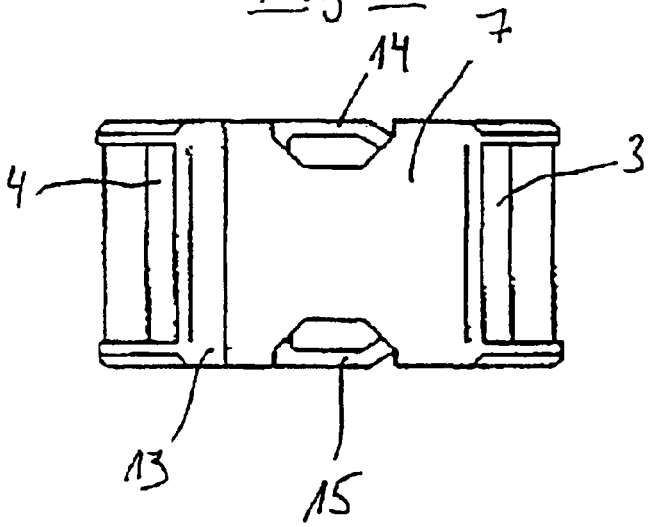
FIG. 3 shows a plan view of the two inter-engaging buckle members.
Figure 2:
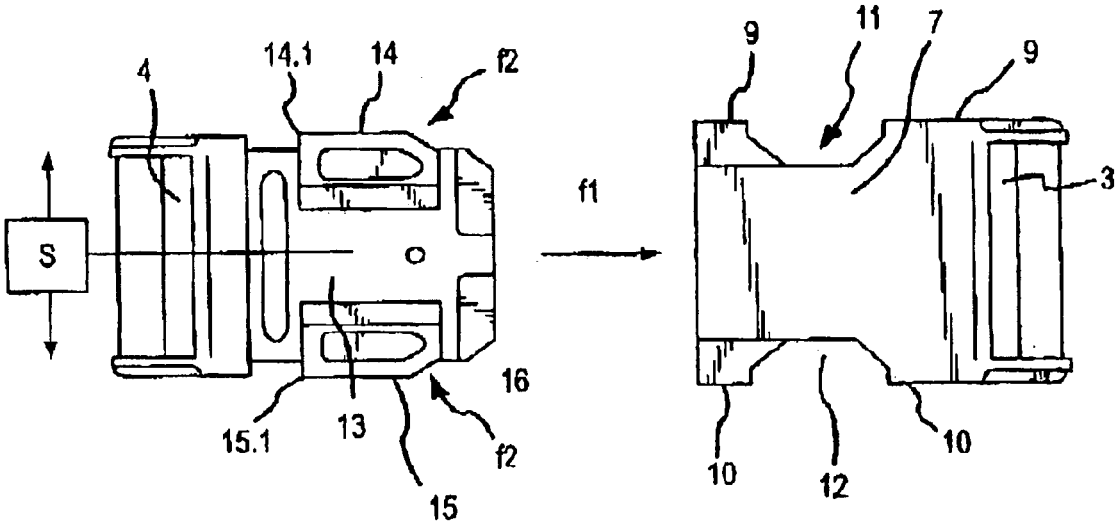
FIG. 2 shows a plan view of the two buckle members, specifically depicting use of a spring, designated with a spring symbol "S" showing directionality of the force of the spring.

Each buckle member is provided at its back end with an eye or loop like opening 3 and 4 respectively for the securement of the buckle members 1 and 2 to the belt ends 5 that are schematically illustrated in FIG. 1. The buckle member 1 is provided with a receiving chamber 6 that is open toward the front end of the buckle member and that is delimited by upper and lower wall portions 7 and 8 as well as side walls 9 and 10. Pursuant to FIG. 2, the upper and lower wall portions 7 and 8 are provided with aligned cutouts or notches 11 and 12 respectively.

The dimensions of the second buckle member 2 are coordinated with the first buckle member 1 in such a way that the second buckle member can be inserted or pushed into the receiving chamber 6 of the first buckle member, and It accordingly comprises a tongue-like main body 13 to which are articulated or coupled two latching or snap-fit elements 14,15 in such a way that when the buckle member 2 is inserted into the buckle member 1, the snap-fit elements can pivot inwardly. As soon as the snap-fit elements 14 and 15 enter the notches 11,12, they are moved or pivoted outwardly by the compression spring (as depicted by box "S" in FIG. 2) that acts upon them, so that their rearwardly facing corners 14.1 and 1.1 come to rest against the side wall portions 9 and 10 that are located in the front portion of the buckle member 1. These side wall portions 9 and 10 thus essentially have the function of undercuts behind which the corners 14.1 and 15.1 catch.

To release the buckle, the snap-fit elements 14 and 15 are manually pressed inwardly in a direction of the arrow f2, so that the rear corners 14.1 and 15.1 are released from the undercuts.

The inventive buckle members are preferably made of die cast brass or sand cast brass or of die cast zinc. The outer surfaces are preferably finished by shot hardening and subsequent galvanization. The galvanization is preferably carried out in a nickel or brass bath. In the event that the galvanization is effected in a chromium bath, a galvanic copper plating preferably takes place first.

The specification incorporates by reference the disclosure of German priority document 20007724.4 filed 2 May 2000 and International priority document PCT/DE01/01585 filed 26 April 2001.

The present invention is, of course, in no way restricted to the specific disclosure of the specification and drawings, but also encompasses any modifications within the scope of the

What is claimed is:

1. A belt buckle comprising:

a first buckle member made of cast metal;

a second buckle member made of cast metal, wherein said first and second buckle members are adapted to be connected to belt ends, and wherein said first buckle member is provided with a receiving chamber for an axial insertion of said second buckle member therein;

snap-fit elements disposed in and coupled to said second buckle member and displaceable against spring force, wherein, to secure said first and second buckle members when they inter-engage one another, said snap-fit elements cooperate with undercuts provided in said first buckle member; and at least one mechanical return spring provided in said second buckle member to effect said spring force against said snap-fit elements.

2. A belt buckle according to claim 1, wherein said first and second buckle members are made of cast brass.

3. A belt buckle according to claim 1, wherein said first and second buckle members are made of cast zinc.

4. A belt buckle according to claim 1, wherein said first and second buckle members have a surface processed by shot hardening and subsequent galvanization.

5. A belt buckle according to claim 4, wherein said first and second buckle members have a surface processed by galvanization in a nickel bath.

6. A belt buckle according to claim 4, wherein said first and second buckle members have a surface processed by galvanization in a brass bath.

7. A belt buckle according to claim 4, wherein said first and second buckle members have a surface processed by copper plating and subsequent galvanization in a chromium bath.

8. A belt buckle according to claim 1, wherein said snap-fit elements are supported against at least one compression spring.

9. A belt buckle according to claim 1, wherein each of said first and second buckle members has either an insertion element or a receiving element disposed in a first plane, and furthermore has a portion that is provided for connection to belt ends and that is disposed in a second plane that is disposed at an angle to said first plane.

* * * * *